US006161598A

United States Patent [19]

Eder et al.

[11] Patent Number: 6,161,598

[45] Date of Patent: Dec. 19, 2000

[54] METHOD FOR PRODUCING HELICALLY WOUND FILAMENT ELEMENTS, AND FILAMENT ELEMENTS PRODUCED ACCORDING TO THIS METHOD

[75] Inventors: Juergen Eder, Cologne; Hans Liermann, Kuerten; Peter Schmidt; Reinhard Sprenger, both of Wipperfuerth, all of Germany

[73] Assignee: Patent-Treuhand-Gesellschaft fuer Elektrische Gluehlampen mbH, Munich, Germany

[21] Appl. No.: 09/052,701

[22] Filed: Mar. 31, 1998

[30] Foreign Application Priority Data

Dec. 20, 1996 [DE] Germany ..... 196 53 572

[51] Int. Cl.[7] ..... B21F 3/04

[52] U.S. Cl. ..... 140/71.5

[58] Field of Search ..... 72/128, 66; 140/71.5

[56] References Cited

U.S. PATENT DOCUMENTS

| | | | |
|---|---|---|---|
| 1,057,088 | 3/1913 | Poag et al. | 140/71.5 |
| 1,553,309 | 9/1925 | Eisler | 72/128 |
| 1,668,016 | 5/1928 | Hauschild et al. | 140/71.5 |
| 2,034,540 | 3/1936 | Smithells | 72/128 |
| 2,371,205 | 3/1945 | Zabel | 72/371 |
| 2,667,204 | 1/1954 | Jaycox | 72/128 |

FOREIGN PATENT DOCUMENTS

| | | | |
|---|---|---|---|
| 53-74353 | 7/1978 | Japan | 140/71.5 |

*Primary Examiner*—Lowell A. Larson
*Attorney, Agent, or Firm*—William E. Meyer

[57] ABSTRACT

A method for producing helically wound filament elements, and filament elements produced according to this method. The method is distinguished in that a thermal treatment of the incandescent wire at temperatures of over 1200° C. takes place already before the winding of the incandescent wire, so that, after separation, the coil springs open and can easily be detached from the core wire.

21 Claims, 3 Drawing Sheets

METHOD FOR PRODUCING HELICALLY WOUND FILAMENT ELEMENTS, AND FILAMENT ELEMENTS PRODUCED ACCORDING TO THIS METHOD

TECHNICAL FIELD

The invention concerns a method for producing helically wound filament elements, in particular incandescent elements. Furthermore, invention is concerned with incandescent elements produced according to a described method. These are, in particular, incandescent elements such as singly, or doubly wound or coiled luminous elements for incandescent lamps, or electrode coils for pin electrodes of high-pressure discharge lamps.

BACKGROUND ART

A method for producing helically wound incandescent elements has been disclosed in EP-A 149 282. Here, incandescent elements are helically wound continuously from an incandescent wire onto a core wire. The incandescent wire (coil) wound onto the core wire is subsequently heated to approximately 1900 to 2200° C. to reduce stresses, for example by means of a laser, high frequency or resistance heating of the core wire. During this, the incandescent wire is clamped on the core wire. The aim is to minimize stresses in the coil. To extract the core wire from the wound incandescent wire, the coil is rotated relative to the core wire in the opposite direction. This complicated method is required because the inside diameter of the coil is matched to the outside diameter of the core wire, and therefore the adherence of the coil to the core wire cannot be avoided.

A similar method with thermal treatment of the incandescent wire to remove the stresses, and subsequent extraction of the core wire from the coil is disclosed in DE-A 34 35 323 and JP-A 49-67 481. The latter uses a lamp as the means for heating the coil to a temperature of between 600 and 900° C.

Coils prepared in these ways do have good dimensional stability. However, the good dimensional stability has the very effect of preventing simple extraction of the core wire from the coil.

SUMMARY OF THE INVENTION

Helically wound filaments, and in particular incandescent filaments, may be made from a high temperature melting wire material that is wound onto a core and thermally treated with the core extracted thereafter, characterized in that the winding wire is first thermally treated, as a result of which it is brought to temperatures in the vicinity of the recrystallization temperature of the material used, and in that the winding wire is wound onto the core immediately thereafter.

It is the object of the present invention to provide a method for producing helically wound filament elements, in particular incandescent elements, having a good dimensional stability, which is simple and time-saving and can therefore be mechanized particularly effectively.

BRIEF DESCRIPTION OF THE DRAWINGS

The aim below is to explain the invention in more detail with the aid of a plurality of exemplary embodiments; in the figures.

BEST MODE FOR MAKING THE INVENTION

Figure 1:
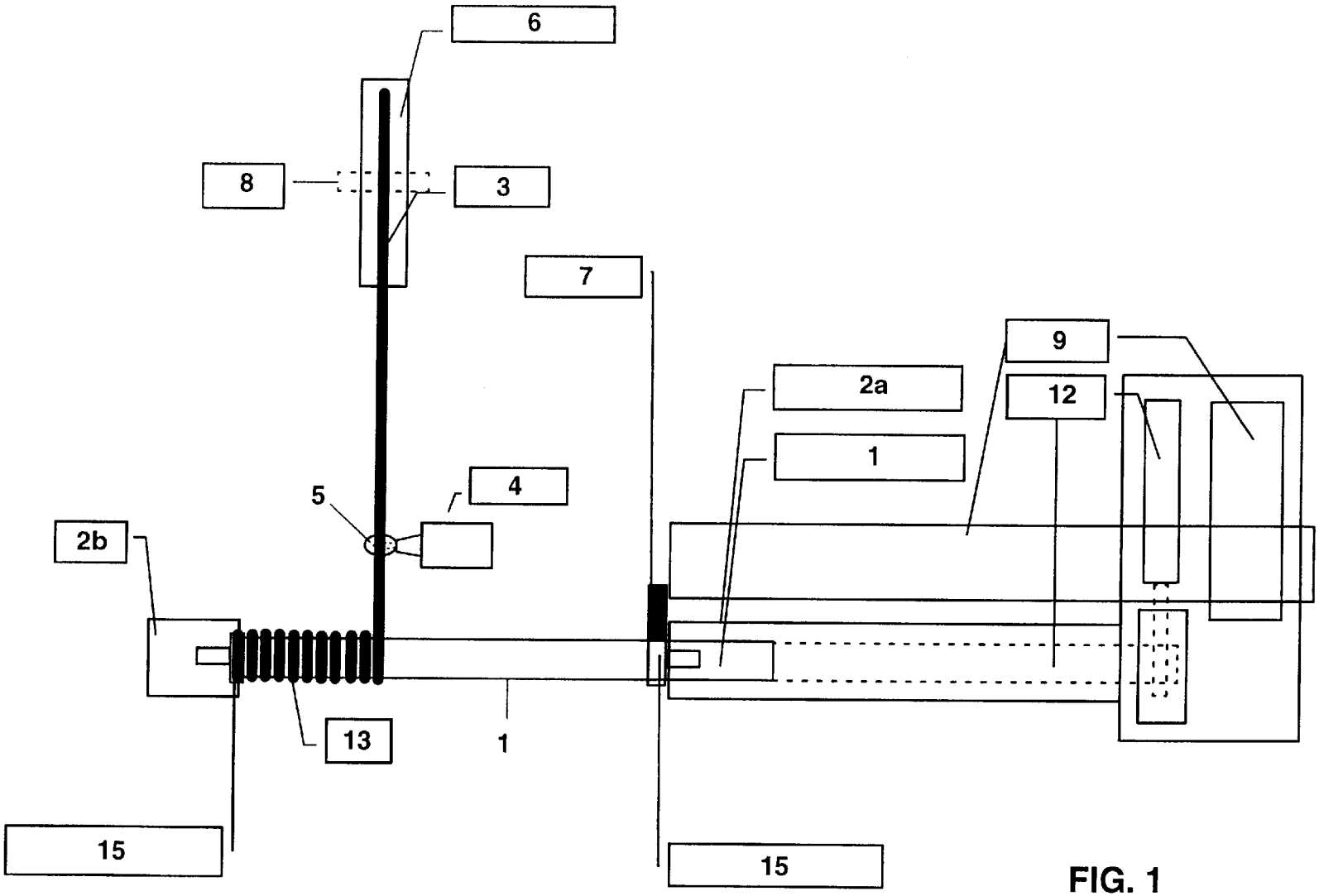
FIG. 1 shows a diagrammatic representation of the winding operation.

FIG. 1 shows the parts of a winding machine which are important for the present invention. In FIG. 1 item 1 is a displaceable machine core. Item 2*a* is a guide bush for the winding core. Item 2*b* is a mating bearing. Item 3 is the winding material. Item 4 is a plasma torch. Item 5 is a flame. Item 6 is a supply coil of the winding material. Item 7 is a wire cutter. Item 8 is the reel axis. Item 9 is a lead drive. Item 12 is a winding drive. Item 13 is a coil. A displaceable machine core 1 made from spring steel is guided at one end in a holder 2*a*, and at the other end in a mating holder 2*b*. It can be retracted in the holder 2*a*, or extracted therefrom. In another embodiment, a fixed machine core and a moving wire feed unit can also be used.

Using winding material coming from a supply reel 6 whose axis 8 is arranged parallel to the machine core 1, an incandescent wire 3 may be wound by means of a wire feed (not represented) onto the machine core 1 to form a coil 13, while maintaining a prescribed lead which is set by means of a pitch or lead drive 9.

Shortly before a section of the incandescent wire 3 meets the machine core 1, it is thermally treated by means of a plasma torch 4. The plasma heating is performed in the free gas flow by means of an argon plasma 5. The plasma torch operates only when a winding drive 12 and the lead drive 9 are active. Once the prescribed length of a luminous element has been wound, a wire cutter 7 comes into action and cuts the luminous element to length. The luminous element springs open and can easily be stripped off, while the machine core 1 is returned. The wire feed restarts immediately thereafter, and the plasma torch comes into action again.

A suitable machine control with appropriate drives (here, a Siemens Standard CNC control) ensures the combination of winding process and simultaneously performed thermal treatment of the winding material as a function of the speed.

Figure 2:
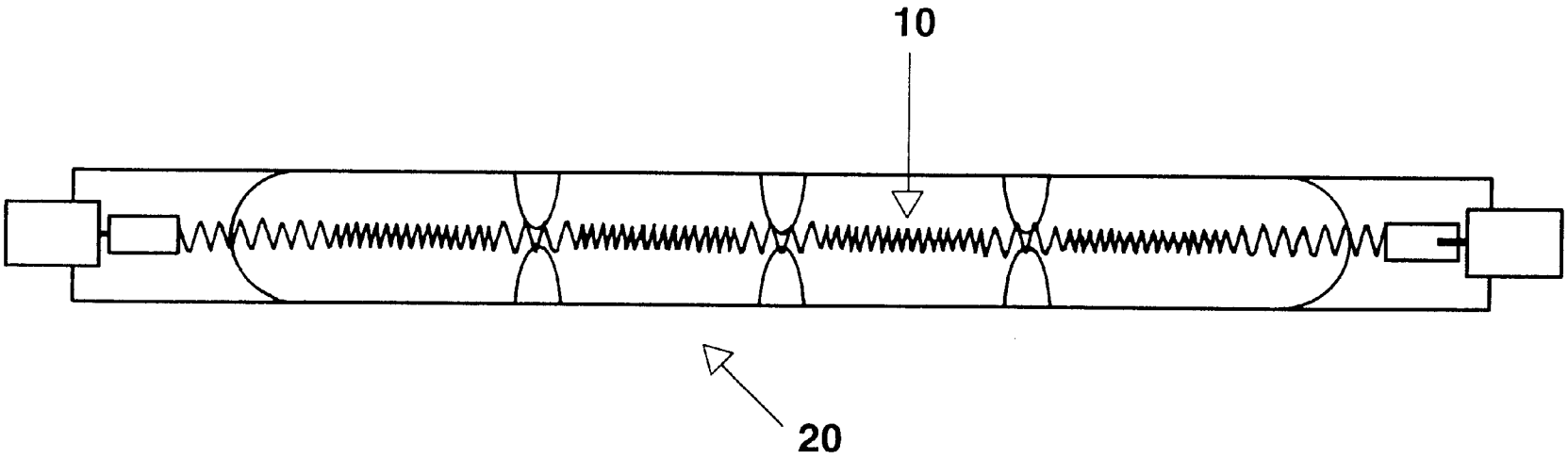
FIG. 2 shows a halogen incandescent lamp with a singly wound incandescent element.

The productivity of the invention is to be seen in that even complicated filaments can be produced. For example, in accordance with FIG. 2 it is possible to produce a singly wound luminous element 10 for tubular lamps 20 (halogen incandescent lamps) with four luminous segments (approximately 70 narrow turns in each case) and three interruptions situated therebetween (five wide turns in each case) as well as two ends (eight wide turns in each case). In this case, the machine core consists of spring steel with a diameter of 1.4 millimeters. The entire clamped length is more than 50 millimeters. The diameter of the incandescent wire is approximately 120 $\mu$m.

Figure 3:
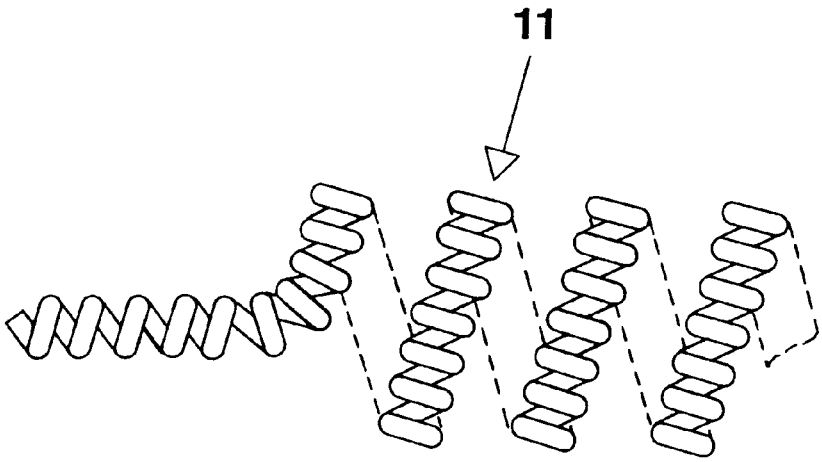
FIG. 3 shows a doubly wound incandescent element for incandescent lamps.

FIG. 3 is a diagram of a doubly wound luminous element 11 whose secondary coil is produced by the method according to the invention. The luminous element consists of tungsten in all the exemplary embodiments.

Figure 4:
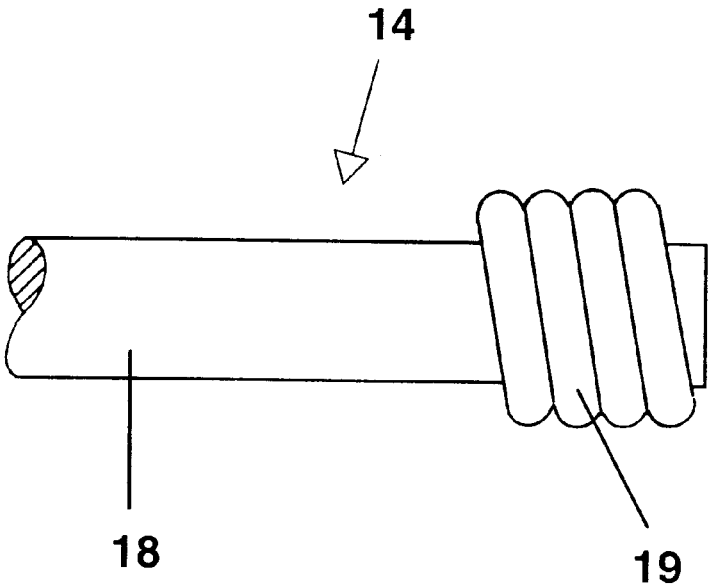
FIG. 4 shows a pin electrode with a burnt-on electrode coil.

Shown in FIG. 4 is an electrode 13 which comprises a core pin or electrode shaft 18 and an electrode coil 19 wound thereon. The electrode coil 19 is permanently burned on the core pin 18.

In one embodiment, the method according to the invention for producing helically wound incandescent elements makes use of the technique, which is basically known per se, in which an incandescent wire made from high-melting material, usually tungsten, is wound onto a core wire and thermally treated, and subsequently separated and the core wire is extracted.

The novel method proceeds in this case from the idea of thermally influencing the winding wire material as early as during the winding operation. By contrast with conventional methods, in which the incandescent wire is likewise wound onto an endless core, in this case the subsequent stress-relieving operation on the core wire by continuous annealing is dispensed with. In particular, the radius of curvature of the reel onto which the incandescent wire is subsequently wound after the heat treatment should be small by comparison with the axial length of the incandescent elements to be produced therefrom. In a particularly preferred embodiment, the coils are separated directly after being wound, with the result that it is possible to dispense with reeling up.

On the one hand, winding produces a permanent plastic deformation beyond the tensile yield point of the winding material, because the winding material must be bent to the radius of the core material, and this imposes a bending stress. On the other hand, the winding process additionally imposes on the winding material an elastic deformation reaching to the tensile yield point of the winding material, the so-called torsional stress. There is then a superimposition of bending stress and torsional stress during winding. The elastic residual stress component (bending and torsion) is released after the separation, and is seen, on the one hand, in the way the coil springs open to have a larger inside diameter. The incandescent element remains dimensionally stable in this case, that is helically wound. On the other hand, the plastic residual stress component is seen in the reduction in the number of the wound turns in conjunction with maintaining the axial length. This is comparable to the opening of a spring in the elastic region of the spring material.

Surprisingly, it has been found that it is possible to ensure an adequate thermal treatment of the winding material directly before the winding operation, specifically without appreciable loss in the customary winding speeds. Particularly when using a plasma torch for the thermal treatment, the energy transfer is so high that speeds of revolution of 10,000 rpm (revolutions per minute) and higher can be reached. Typical values are 6000 to 8000 rpm.

The first method step consists according to the invention in that the incandescent wire is thermally treated.

In the case of the production of incandescent elements, the incandescent wire must be brought to a temperature of up to near the recrystallization temperature of the material. A temperature in the region of between 60 and 90% of the recrystallization temperature is preferably suitable for this. In the case of tungsten, this means that the incandescent wire is brought to a temperature of more than 1200° C., preferably to more than 1400° C. The recrystallization temperature of tungsten is at about 1800° C.

At temperatures above 1800° C., a range is entered in which the tungsten sintered material begins to recrystallize, which is seen in increasing embrittlement. The material thereby becomes fragile. As a result, however, in the case of further processing (mounting of retaining rings or end pieces on the filament or long-drawing of the filament element) a high number of rejects would have to be expected.

In a second embodiment, by contrast, the production of electrode coils requires still higher temperatures, which are preferably in the region of the recrystallization temperature, because the imposed stresses are not intended to be released any longer in this case. A certain degree of recrystallization is thus desired.

Immediately thereafter, the heated incandescent wire or filament element is wound onto the core. To prevent a marked cooling of the coil thus produced, the coil is heated directly in the vicinity of the core. Here, the term core covers both core wires and solid core pins.

In the next step, the coil, which is still hot but already slightly cooled, is separated from the core wire. If the coil is still too hot before the separation, its color is tarnished or oxidation can occur. In the most unfavorable case, the coil springs open too little or not at all. Again, the so-called useful life of the core depends thereon. In this case, the finished coil still has, during separation, residual stress, which is converted immediately after the separation into an enlargement of the inside diameter of the coil, with the result that the coil loses intimate contact with the core wire. It is now seated only loosely on the core wire. For this reason, it is easy the last step to extract the loosely seated core wire from the coil thereon.

It is preferred in both embodiments to perform the thermal treatment of the winding wire by means of a plasma torch. The principle of such a plasma torch is described in more detail, for example, in NL-A 71 12 767. Argon, helium, hydrogen, nitrogen and their mixtures, for example, can be used as plasma.

It has proved to be particularly suitable for the present purposes that the plasma combustion is performed in the free gas flow, argon, an argon/nitrogen mixture or an argon/hydrogen mixture being applied in particular. In particular, nitrogen can also be used as inert-gas cone. It is advantageous for both the anode and the cathode of the plasma torch to be located in the torch housing.

The incandescent wire is advantageously to reach a temperature of more than 1200° C. before winding.

Since an exchangeable core (machine core) stabilizes the winding process and minimizes tolerances in the winding process, it is particularly well suited as the core. It is to be recommended in this case that the machine core consists of material, such as spring steel or tungsten, for example, which can be subjected to a high thermal load (in the temperature range around 1800° C.). The machine core should effectively endure temperatures of up to more than 1800° C.

The material of the winding wire is typically tungsten, which can possibly be doped with additives such as potassium, silicon, aluminum and/or thorium.

The present invention also comprises incandescent elements or electrodes having electrode coils which are produced according to the method described above, as well as lamps produced therefrom.

As a result of the novel method, in the production of incandescent elements the stress introduced into the coil by the winding operation is influenced as a consequence of the thermal treatment undertaken shortly in advance precisely to the effect that the coil is able to spring open radially after the separation as a consequence of the stored mechanical energy. The elastic residual stress component described above is precisely the process of springing open radially. Because of this, the coil is detached automatically from the core wire, by contrast with the prior art, in which this method step presents the greatest problem.

A particular advantage is the surprising property that the coil remains virtually dimensionally stable in the axial direction. The process of springing open axially is, similar to that of the opening of a spring, also elastic, and is seen in the reduction of the wound turns in conjunction with maintaining the prescribed winding length. In the present invention, the small axial residual stress is seen in the fact that it effects only a slight spread in the total length of the helically wound incandescent element.

The temperature at the thermal pretreatment is now selected precisely such that the desired final inside diameter of the coil is produced automatically by the process of springing open radially after the separation. In the particular individual case, the precise dimensioning is a function essentially of the diameter of the core material and winding material, of the temperature and also of the winding speed.

The enlargement of the inside diameter of the coil, occasioned by the process of springing open radially, is specific to type and varies in a range from 2 to 30%.

In other words, the desired dimensions of the coil can be achieved with a smaller core wire compared to the prior art.

The method according to the invention is basically suitable for two different applications:

Firstly, it can be used to produce for incandescent lamps luminous elements which are singly or doubly wound. In the case of the singly wound luminous element (coiled filament), the method can be applied directly as described.

In the case of the doubly wound luminous element (coiled-coil filament), the method must be modified by using a conventionally produced endless primary coil, which is still wound on a core wire, as core wire for a secondary coil. The method described above is then applied to produce the secondary coil. Thereafter, the further processing steps are then performed, or the primary core is immediately extracted.

The method is suitable for all known diameters of the core wire or incandescent wire, and can be applied to all known pitches or leads. Because of the increasing surface adhesion, with decreasing diameter of the incandescent wire and core wire a tendency is observed for the incandescent wire to adhere to the core wire. A remedy is provided here by a periodically alternating use of a plurality of corewires. Depending on the load, use is made in this case of 5 to 50, or even more core wires or core pins. This so-called revolver technique permits a longer period of use (useful life) of a machine core.

Revolver technique is understood as automatically feeding a material before the (n+1)th process step, but after the preceding n-th process step has been completely executed. In the case of a revolver, this corresponds to automatic feeding of the next cartridge chamber together with contents after a shot has been fired.

Winding material at an increased temperature onto a machine core increases the temperature of the machine core over its period of use until a steady-state temperature equilibrium is produced between the machine material, winding material and the ambient temperature. With increasing temperature of the machine core, its stability decreases, that is to say it becomes softer and more unstable (harder and more brittle in the case of sintered materials), becoming more sensitive for the overall process, as a result. By applying the revolver technique, the individual core is capable of cooling again during the useful life of the other cores alternatively used (typically 5 to 50 cores). It is possible thereby to achieve a substantially longer useful life and also a smaller spread in the geometry of the coil.

A second field of application is pin electrodes with applied electrode coils. Such electrodes are disclosed, for example, in U.S. Pat. No. 3,067,357. According to the method of the invention, such electrodes can be produced by applying particularly high temperatures, which are in the region of the recrystallization temperature of the material used, in the thermal treatment of the winding wire. In the case of tungsten, the temperatures are preferably around or slightly above 1800° C. The elastic residual stresses, which cause the electrode coil to spring open, are thereby prevented. The winding wire can be "permanently burned" on the core pin or electrode shaft in this way.

This increased temperature effect produces a balance between the elastic residual stresses and the chemical and structural conditions. The imposed stresses are nothing other than a forced minimal change in the crystal lattice of a grain or crystallite, which are also reflected in the bond lengths, bond angles and bonding forces. With each increase in the temperature of a material, the position of the atoms in the crystal lattice is further smeared, that is to say their position becomes ever more unfavorable in terms of energy for a special structure up to the reversible phase transformation (for example transformation of the $\alpha$ phase of a crystal into the $\beta$ phase), a different structure, more favorable in terms of energy, being adopted from a specific temperature for the prevailing conditions. The sum of the microscopic lattice distortions produces the macroscopic residual stress component.

By contrast with the winding of incandescent elements (at 1200–1800° C. in the case of tungsten), the production of electrodes with electrode coils by the method according to the invention therefore requires a larger energy transfer (corresponding to a temperature of above 1800° C. for tungsten, which is thus in the region of recrystallization), so that the residual stress component is not elastically imposed by lattice distortions, but the stresses are compensated by a structural "reorganization" of the lattice components (partial recrystallization or complete recrystallization) accompanied by maintenance of the natural structure. In general, in the case of winding electrode coils onto electrodes the plasma temperature is preferably set such that the temperature of the winding material comes approximately into the region of the so called solid/liquid transition. The material is thus deformed "in a soft state", and the bonding distances in the lattice are relatively large, and thus the bonding forces are relatively small. After the shaping process step, which is carried out very quickly, the material has sufficient time to form a new structure by partial or complete recrystallization without the imposition of stresses into the lattice. The original structural type of the crystal lattice is maintained in this process. With increasing cooling time, the bonding conditions are normalized again, and the electrode coil is seated without stress (permanently burned) on the electrode shaft.

In the prior art, holding the electrode coils on the pin has to be realized by welding or by a press fit. This additionally required welding step causes a similar structural change to the operation described above, but only in the region of the welding zone.

The press fit is the reversal of the technique of winding incandescent elements. Specifically, an elastic electrode coil is subsequently provided with a core pin whose outside diameter is larger than the inside diameter of the electrode coil. The electrode coil is widened in the process. The elastic deformation produces a resilient force due to the feeding of the pin. The pin is thus secured by the friction of the individual turns.

In known electrodes, therefore, the electrode coil is normally pushed on and then welded to the core pin, or the core pin is subsequently pushed into the electrode coil (press fit). In the method according to the invention, however, here is no need either for welding or pressing in, since the electrode coil is held effectively on the core wire by itself. In particular, there is no longer a possibility of point-size damage to the electrode (embrittlement), as could not be avoided in the case of the welding operation.

It is possible by using the method according to the invention to achieve very high setting powers, if the entire method is taken into consideration. It is true that by comparison with other machines which do not undertake separation of the coil during winding (so-called lasso machines, see DE-A 16 39 095), the setting power is lower during winding. However, in return, the time expended for all subsequent method steps is substantially shorter, and a range of method steps is eliminated completely, in particular the troublesome extraction of the core wire. Also eliminated are the provision of an endless winding core, as well as the annealing for dimensional stability as a separate method step, and the subsequent separating process.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of making helically wound filament elements comprising the steps of:

a) coupling a high temperature filament wire to a machine core, the machine core being rotatable and axially displaceable from a holder, the wire extending from a wire dispenser;

b) rotating the machine core while axially displacing the machine core to wind the wire on the machine core;

c) heating a section of the wire between the wire dispenser and the machine core as the wire is being wound on the rotating machine core;

d) after winding one or more turns of wire on the machine core; cutting the wire between the wire dispenser and the machine core leaving a wound section of wire on the machine core; and e) axially withdrawing the machine core with respect to the wound section of wire, thereby mechanically separating the wound section of wire from the machine core.

2. The method in claim 1 wherein:

a) the winding wire (3) is first thermally treated before the wire is wound onto the core, as a result of which the wire is brought to a temperature between 1200 degrees Celsius and 1800 degrees Celsius to be in the vicinity of, but less than the recrystallization temperature of the material used, and b) the winding wire (3) is wound onto the core (1) immediately thereafter.

3. The method according to claim 1, characterized in that the thermal treatment is performed by means of a very high temperature convective heat source (4).

4. The method according to claim 3, characterized in that the thermal treatment is performed in a free gas flow (5).

5. The method according to claim 4, characterized in that the free gas flow includes an argon and nitrogen mixture.

6. The method according to claim 4, characterized in that the free gas flow includes an argon and hydrogen mixture.

7. The method according to claim 3, wherein the very high temperature convective heat source (4) is a plasma torch.

8. The method according to claim 1, characterized in that the winding wire (3) is an incandescent wire for luminous elements of an incandescent lamp, and in that the core is a core wire.

9. The method according to claim 8, characterized in that subsequent to the method step b) the following further method steps are also carried out, specifically:

c) that the incandescent wire is subsequently separated, the finished coil still having during separation a residual stress which is converted immediately after separation into an enlargement of the inside diameter of the coil, with the result that the coil loses the intimate contact with the core, d) and that, finally, the core is extracted from the coil, which is seated thereon loosely.

10. The method according to claim 8, characterized in that before the winding the incandescent wire reaches a temperature of just below the recrystallization temperature of the material used, preferably of between 60 and 90% of the recrystallization temperature.

11. The method according to claim 8, characterized in that the core is an exchangeable machine core.

12. The method according to claim 11, characterized in that the machine core consists of material which can be subjected to a high thermal load.

13. The method according to claim 11, characterized in that the extraction of the core wire is performed by retracting the machine core.

14. The method according to claim 1, characterized in that the winding wire forms an electrode coil for the electrode of a discharge lamp, and in that the core is a core pin or electrode shaft.

15. The method according to claim 14, characterized in that in the method step a) the winding wire is brought to temperatures around or slightly above the recrystallization temperature of the material used, in particular to temperatures in the vicinity of the solid/liquid transition.

16. The method according to claim 1, characterized in that the material of the winding wire is tungsten.

17. An incandescent filament produced according to the method in claim 1.

18. A lamp having a filament element or electrode produced in accordance with the method in claim 1.

19. The method according to claim 1, characterized in that the winding wire (3) is an incandescent wire for luminous elements of an incandescent lamp and in that the core is a machine core (1).

20. A method for producing helically wound filament elements in which a winding wire (3) made from tungsten is wound onto a core (1) with a circular cross-section and thermally treated, and the core is extracted, characterized a) in that the winding wire (3) is first thermally treated before the wire is wound onto the core by a very high temperature convective heat source (4), as a result of which the wire is brought to a temperature between 1200 degrees Celsius and 1800 degrees Celsius to be in the vicinity of, but less than the recrystallization temperature of the tungsten material used, and b) in that the winding wire (3) is rapidly wound onto the core (1) immediately thereafter.

21. The method according to claim 20, wherein the coiling speed is not less than 6000 revolutions per minute, and the thermal treatment and coiling are adjusted for the winding wire and core so that the filament springs open radially after separation from the core.

* * * * *